US006319476B1

(12) United States Patent
Victor, Jr. et al.

(10) Patent No.: US 6,319,476 B1
(45) Date of Patent: Nov. 20, 2001

(54) MICROFLUIDIC CONNECTOR

(75) Inventors: Richard L. Victor, Jr., Mendon; Jeffrey H. Stokes, Franklin, both of MA (US)

(73) Assignee: Perseptive Biosystems, Inc., Framingham, MA (US)

( * ) Notice: Subject to any disclaimer, the term of this patent is extended or adjusted under 35 U.S.C. 154(b) by 0 days.

(21) Appl. No.: 09/261,013

(22) Filed: Mar. 2, 1999

(51) Int. Cl.[7] ..... B01L 11/00

(52) U.S. Cl. ..... 422/103; 422/70; 422/99; 422/100; 422/104; 436/174; 436/180; 210/198.2

(58) Field of Search ..... 422/79, 99, 100, 422/102, 103, 104, 68.1; 436/174, 179, 180; 210/198.2

(56) References Cited

U.S. PATENT DOCUMENTS

| | | | |
|---|---|---|---|
| 3,266,554 | 8/1966 | Brownrigg . | |
| 3,884,802 | 5/1975 | Spaans et al. | 210/31 C |
| 4,139,458 | 2/1979 | Harrison | 210/31 C |
| 4,346,001 | 8/1982 | Tyihák et al. | 210/198.3 |
| 4,438,205 | 3/1984 | Saint-Leger et al. | 436/71 |
| 4,734,187 | 3/1988 | Visentin et al. | 210/101 |
| 4,911,837 | 3/1990 | Allington et al. | 210/198.2 |
| 4,991,883 | 2/1991 | Worden | 285/334.4 |
| 5,095,932 | 3/1992 | Garrison | 137/205.5 |
| 5,151,178 | 9/1992 | Nickerson et al. | 210/198.2 |
| 5,234,235 | 8/1993 | Worden | 285/334.4 |
| 5,234,587 | 8/1993 | Allington et al. | 210/198.2 |
| 5,378,361 | 1/1995 | Baeckstrüm | 210/198.2 |
| 5,393,420 | 2/1995 | Hutchins et al. | 210/198.2 |
| 5,423,982 | 6/1995 | Jungbauer et al. | 210/198.2 |
| 5,500,071 | 3/1996 | Kaltenbach et al. | 156/272.8 |
| 5,614,154 | 3/1997 | Glatz et al. | 422/103 |
| 5,645,702 | 7/1997 | Witt et al. | 204/501 |
| 5,646,048 | 7/1997 | Templin et al. | 436/180 |
| 5,650,846 | 7/1997 | Yin et al. | 356/318 |

(List continued on next page.)

FOREIGN PATENT DOCUMENTS

| | | | |
|---|---|---|---|
| 0 354 659 | 2/1990 | (EP) | F02M/61/16 |
| WO97/2282 | 6/1997 | (WO) . | |
| 98/33001 | 7/1998 | (WO) . | |
| 98/37397 | 8/1998 | (WO) | G01N/1/00 |

OTHER PUBLICATIONS

Gonzalez, C. et al., "Fluidic Interconnects For Modular Assembly Of Chemical Microsystems," 1997 International Conference on Solid–State Sensors and Actuators, pp. 527–530, Chicago, Jun. 16–19, 1997.

Spiering, Vincent L. et al., "Novel Microstructures And Technologies Applied In Chemical Analysis Techniques," 1997 International Conference on Solid–State Sensors and Actuators, pp. 511–514, Chicago, Jun. 16–19, 1997.

Harrison, Jed, "Microfabrication Of Chemical Systems," Chapter 15, Microsystems: Mechanical, Chemical, Optical, pp. 15–42, 7/97.

*Primary Examiner*—Jill Warden
*Assistant Examiner*—Dwayne K. Handy
(74) *Attorney, Agent, or Firm*—Testa, Hurwitz & Thibeault, LLP

(57) ABSTRACT

A fluid connector which provides a low fluid dead volume face seal capable of withstanding high pressures for coupling a fluid conduit to a microfluidic device. The fluid connector includes a housing, a clamping member, a first load support surface and a sealing member. The sealing member preferably includes first and second fluidically connected bores of different diameters so the fluid conduit may be retained within the larger diameter bore. The sealing member is positioned so that the smaller diameter bore interfaces with a port of the microfluidic device. In operation, the clamping member supplies an axial force to the first load support surface which is operatively coupled to the fluid conduit. When an axial force is transferred to the fluid conduit, the face of the fluid conduit at one end seals against the pliant portion of the sealing member while simultaneously urging the sealing member against the surface area surrounding the port of the microfluidic device to create a fluid-tight face seal.

20 Claims, 3 Drawing Sheets

U.S. PATENT DOCUMENTS

| | | | |
|---|---|---|---|
| 5,653,876 | 8/1997 | Funke | 210/198.2 |
| 5,660,727 | 8/1997 | Gleave et al. | 210/141 |
| 5,674,455 | 10/1997 | Marchand et al. | 722/70 |
| 5,730,943 | 3/1998 | Ford et al. | 422/101 |
| 5,744,726 | 4/1998 | Maurer | 73/727 |
| 5,833,926 | 11/1998 | Wurzel et al. | 422/81 |
| 6,117,396 | 9/2000 | Demers | 422/100 |
| 6,136,269 | 10/2000 | Winkler et al. | 422/61 |

MICROFLUIDIC CONNECTOR

FIELD OF THE INVENTION

The present invention relates to fluid connectors. More specifically, the invention relates to fluid connectors used for coupling fluid conduits to microfluidic devices.

BACKGROUND OF THE INVENTION

Devices for performing chemical analysis have in recent years become miniaturized. For example, microfluidic devices have been constructed using microelectronic fabrication and micromachining techniques on planar substrates such as glass or silicon which incorporate a series of interconnected channels or conduits to perform a variety of chemical analysis such as capillary electrophoresis (CE) and high-performance liquid chromatography (HPLC). Other applications for microfluidic devices include diagnostics involving biomolecules and other analytical techniques such as micro total analysis systems ($\mu$TAS). Such devices, often referred to in the art as "microchips," also may be fabricated from plastic, with the channels being etched, machined or injection molded into individual substrates. Multiple substrates may be suitably arranged and laminated to construct a microchip of desired function and geometry. In all cases, the channels used to carry out the analyses typically are of capillary scale dimension.

To fully exploit the technological advances offered by the use of microfluidic devices and to maintain the degree of sensitivity for analytical techniques when processing small volumes, e.g., microliters or less, connectors which introduce and/or withdraw fluids, i.e., liquids and gases, from the device, as well as interconnect microfluidic devices, are a crucial component in the use and performance of the microfluidic device.

A common technique used in the past involves bonding a length of tubing to a port on the microfluidic device with epoxy or other suitable adhesive. Adhesive bonding is unsuitable for many chemical analysis applications because the solvents used attack the adhesive which can lead to channel clogging, detachment of the tubing, and/or contamination of the sample and/or reagents in or delivered to the device. Furthermore, adhesive bonding results in a permanent attachment of the tubing to the microfluidic device which makes it difficult to change components, i.e., either the microfluidic device or the tubing, if necessary. Thus assembly, repair and maintenance of such devices become labor and time intensive, a particularly undesirable feature when the microfluidic device is used for high throughput screening of samples such as in drug discovery.

To avoid problems associated with adhesive bonding, other techniques have been proposed in the past, e.g., press fitting the tubing into a port on the microfluidic device. However, such a connection typically is unsuitable for high-pressure applications such as HPLC. Additionally, pressing the tubing into a port creates high stress loads on the microfluidic device which could lead to fractures of the channels and/or device.

Other methods involved introducing liquids into an open port on the microfluidic device with the use of an external delivery system such as a pipette. However, this technique also is undesirable due to the possibility of leaks and spills which may lead to contamination. In addition, the fluid is delivered discretely rather than continuously. Moreover, the use of open pipetting techniques does not permit the use of elevated pressure for fluid delivery such as delivered by a pump, thereby farther restricting the applicability of the microfluidic device.

Therefore, a need exists for an improved microfluidic connector which is useful with all types of microfluidic devices and provides an effective, high pressure, low fluid dead volume seal. The connector also should overcome the disadvantages and limitations described above, including chemical compatibility problems resulting from the use of adhesive bonding techniques.

SUMMARY OF THE INVENTION

The present invention is directed to a fluid connector which couples a microfluidic device, e.g., a chemical analysis device, to a fluid conduit used for introducing and/or withdrawing liquids and gases from the microfluidic device. A fluid connector of the invention provides a fluid-tight seal with low fluid dead volume which is able to withstand high-pressure applications, e.g., 3000 pounds per square inch (psi) or greater.

A fluid connector of the invention includes a housing, a clamping member, a first load support surface and a sealing member. The housing has a bore extending through it for receiving the fluid conduit and for positioning one end of a fluid conduit for connection to a port of a microfluidic device. The housing typically has a top plate and a bottom plate. The top plate often has a bore extending completely through it and the bottom plate supports the microfluidic device adjacent to the bore.

The clamping member is located remotely from the end of the fluid conduit which communicates with the microfluidic device. In use, the clamping member directly or indirectly applies an axial force to the first load support surface, e.g., a ferrule or protrusion on the fluid conduit, which operatively is coupled to the fluid conduit between the clamping member and the end of the fluid conduit. The clamping member may be a compression screw or other similar device. The clamping member also may be a surface of the top plate of the housing such that as the top plate and bottom plate are mated, an axial force is applied to the first load support surface thereby urging the fluid conduit towards a port on the microfluidic device.

The sealing member is interposed between the end of the fluid conduit and the surface area surrounding the microfluidic device port. At least the portion of the sealing member adjacent to the port of the microfluid device is made of a pliant material, thereby defining a pliant portion of the sealing member. In this respect, the pliant portion of the sealing member also is in communication with the end of the fluid conduit which is coupled to the microfluidic device. A first bore of the sealing member extends through the sealing member which permits fluid communication between the fluid conduit and the port of the microfluidic device.

In its simplest form, the sealing member is a gasket or flat elastomeric "washer." However, additional structure and/or designs are contemplated by this invention as disclosed herein or which are known to skilled artisans. For example, the sealing member may have a second bore. The second bore of the sealing member typically is sized and shaped to match the outer diameter of the fluid conduit thereby creating a second load support surface and permitting the conduit to be maintained in a fixed relation with respect to the microfluidic device port. The sealing member often is formed of a pliant material such as an elastomer or a polymer. In using this type of sealing member, the axial force applied to the first load support surface urges the end of the fluid conduit against the second load support surface while simultaneously urging the pliant portion of the sealing member against the surface area surrounding the port of the microfluidic device to provide a fluid-tight face seal.

Other structures which may be present in a fluid connector of the invention include an elastic member such as a spring, and/or an alignment mechanism. The elastic member may be used to facilitate and maintain the fluid-tight face seal especially when the fluid connector experiences a range of temperatures. The alignment mechanism readily facilitates connection of the fluid conduit and the microfluidic device without requiring precise manual positioning of the components. The alignment mechanism also permits the fluid connector of the invention to be used in automated techniques.

The present invention provides several advantages which are especially important for conducting chemical analysis using microfluidic devices. For example, the fluid connector of the invention provides a seal which extends across essentially the entire face of the fluid conduit, thereby minimizing fluid dead volume between the end of the fluid conduit and the port of the microfluidic device. In other words, the region of unswept fluid volume is extremely low which assures proper flushing of reagents and sample during an analytical application so that the effects of contamination essentially are eliminated. In addition, a fluid connector of the invention provides a low cost, high pressure seal which is easily removable and reusable. Moreover, the present invention provides a self-aligning connection which readily is adapted to individual microchip assemblies having a high fitting density.

These, as well as other aspects, advantages and objects of the present invention will be apparent from the following detailed description of the invention taken in conjunction with the drawings.

DETAILED DESCRIPTION OF THE INVENTION

The present invention is directed to a fluid connector which couples a fluid conduit to a microfluidic device using a sealing member which provides a fluid-tight seal able to withstand high pressures. It should be understood that the discussion and examples herein are directed to preferred embodiments of the invention. However, the same principles and concepts disclosed in this specification equally apply to the construction and use of other fluid connectors expressly not disclosed, but within the knowledge of a skilled artisan, and the spirit and scope of the invention.

Figure 1:
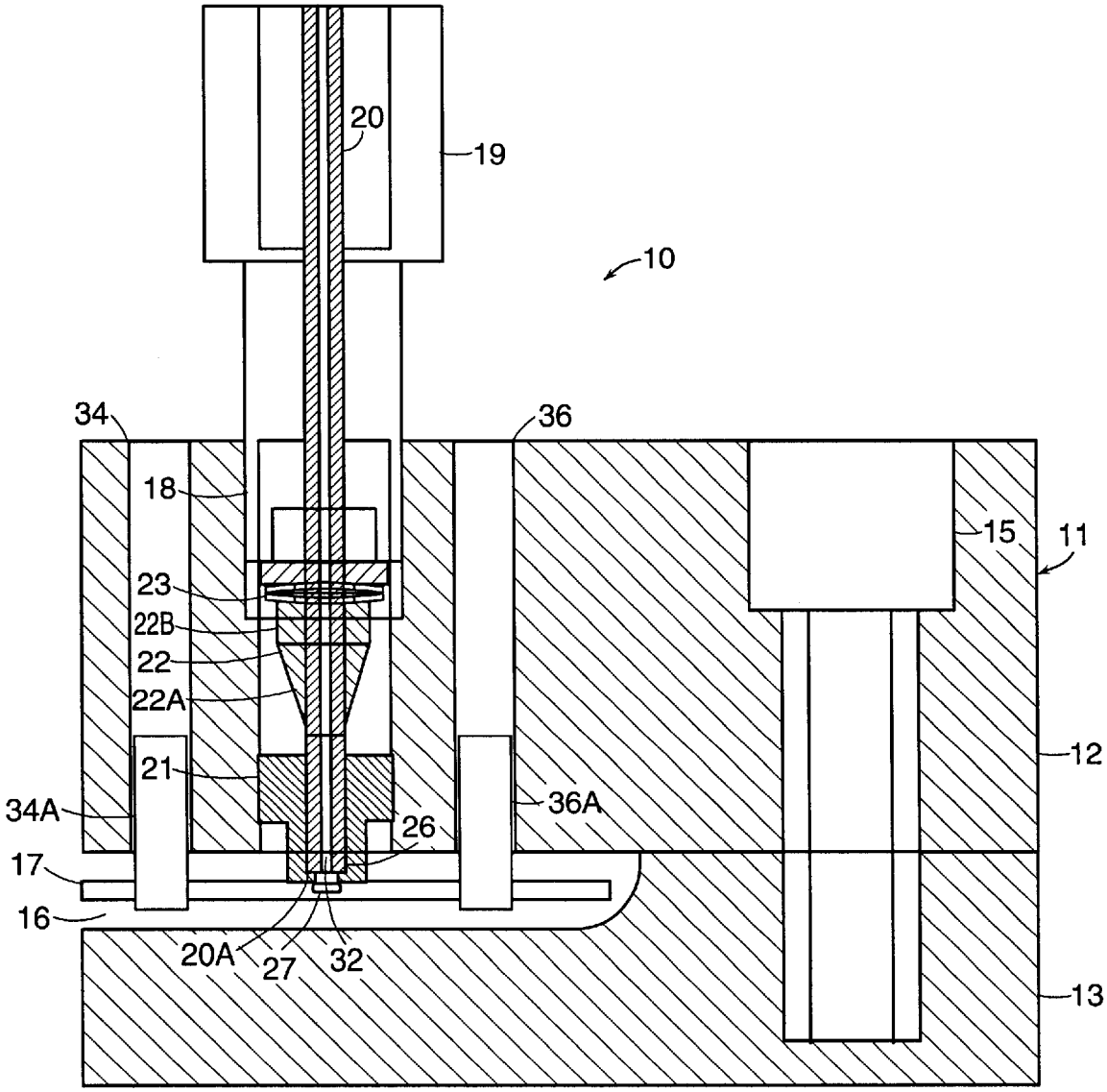
FIG. 1 is a cross-sectional view of a preferred embodiment of a fluid connector of the present invention which is coupled to a microfluidic device.

FIG. 1 shows a non-limiting example of preferred fluid connector 10 constructed in accordance with the present invention which includes housing 11 formed of top plate 12 and bottom plate 13. Top plate 12 and bottom plate 13 are clamped together by threaded bolt 15. Preferably, the plates are made of a suitable polymeric material such as acrylic. However, the plates may be constructed of metal or other appropriate material. A portion of bottom plate 13 is machined to form slotted recess 16 in which microfluidic device 17 is positioned and supported.

Threaded bore 18, which engages the threaded shaft of compression screw 19, extends through top plate 12 to open at slotted recess 16. Fluid-carrying tubing 20, i.e., a fluid conduit, is inserted through an axial bore in compression screw 19 and the larger diameter bore of a sealing member, i.e., cup seal 21 (see also FIG. 2 for an enlarged view of sealing member 21). The fluid conduit may be made of any suitable material, e.g., polyetheretherketone (PEEK). Tubing face 20A of tubing 20, i.e., the bottom surface perpendicular to the longitudinal flow axis of tubing 20, is positioned within cup seal 21 and retained therein against lateral edge 21A, i.e., a second load support surface. Cup seal 21 may be constructed of ultra-high molecular weight polyethylene (UMWPE) or other suitable pliant material. Although the whole cup seal need not be made of pliant material, the portion which contacts the fluid conduit and the surface of the microfluidic device around its port needs to be of a pliant material to effect the proper seal. Referring to FIG. 1, tubing 20 and cup seal 21 are centered above port 27 on microfluidic 17 device.

Metal ferrule 22 is swaged onto tubing 20 with its tapered end 22A proximate to tubing face 20A of tubing 20 and its base 22B proximate to the bottom surface of compression screw 19. Compression spring 23 in the form of a Belleville washer is positioned between ferrule 22 and compression screw 19 and is constrained therein by base 22B of ferrule 22 and the bottom surface of compression screw 19. The force generated by spring 23 is applied axially against base 22B of ferrule 22, which forces tubing face 20A of tubing 20 against lateral edge 21 A of cup seal 21. Due to the pliant nature of cup seal 21, a fluid-tight face seal is established between tubing face 20A and lateral edge 21A while the base 26 of cup seal 21 concurrently produces a fluid-tight face seal with the surface area surrounding port 27 on microfluidic device 17. The effect of this arrangement is to create a fluid-tight face seal between tubing 20 and port 27 on microfluidic device 17.

While microfluidic devices useful with the present invention can take a variety of forms, they generally are characterized by having one or more ports for introducing or withdrawing fluids to or from the device. The device often includes one or more channels for conducting chemical analyses, mixing fluids, or separating components from a mixture that are in fluid communication with the ports. The channels typically are of capillary scale having a width from about 5 to 500 microns ($\mu$m) and a depth from about 0.1 to 1000 $\mu$m. Capillary channels may be etched or molded into the surface of a suitable substrate then may be enclosed by bonding another substrate over the etched or impressed side of the first substrate to produce a microfluidic device. The width and depth of a microfabricated channel may be adjusted to facilitate certain applications, e.g., to carry out solution mixing, interchannel manifolding, thermal isolation, and the like. In one embodiment, the microfluidic device is fabricated from fused silica, such as quartz glass. In other embodiments, the microfluidic device may be constructed from silicon or plastic.

In accordance with the present invention, the creation of a reliable, fluid-tight face seal between fluid-carrying tubing and the associated port a microfluidic device assures that the area of fluid dead volume, i.e., the area that is void of fluid during flushing, is minimized.

Figure 2:
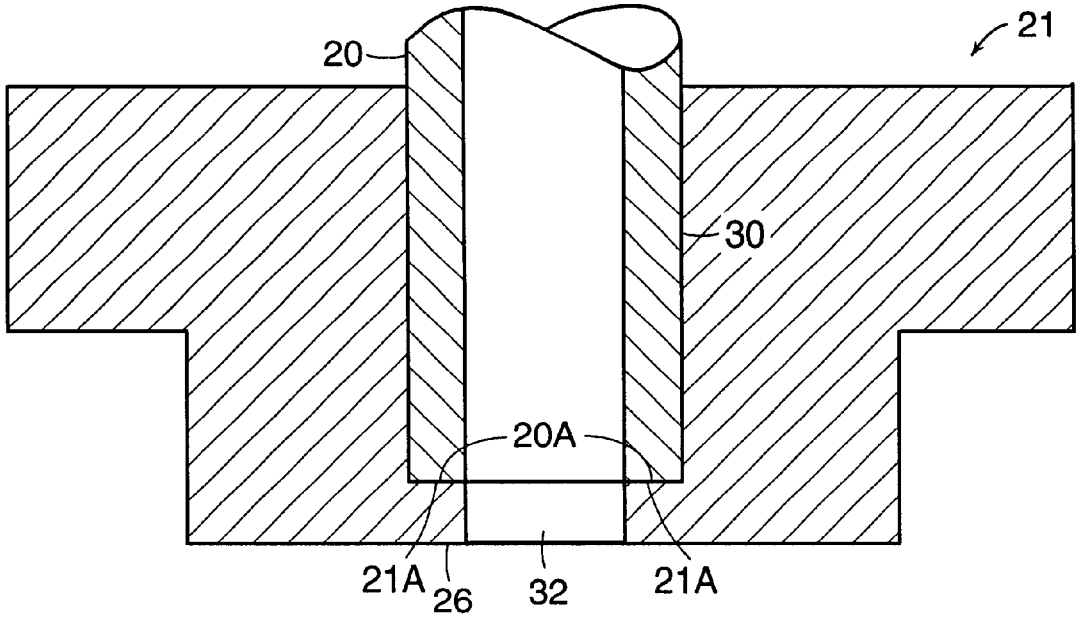
FIG. 2 is an enlarged cross-sectional view of a sealing member similar to that used in the embodiment shown in FIG. 1.

FIG. 2 illustrates the details of a preferred sealing member of the present invention. Cup seal 21 includes a second bore 30 having an diameter which matches the outer diameter of tubing 20. As shown, tubing face 20A of tubing 20 contacts lateral edge 21A of cup seal 21 throughout essentially the entire radial width of the face 20A. Lateral edge 21A terminates at first bore 32 which has a smaller diameter than second bore 30. Referring back to FIG. 1, first bore 32 extends through the remainder of cup seal 21 to communicate with port 27 of microfluidic device 17.

As seen in FIG. 2, the seal region provided by cup seal 21 between tubing face 20A and lateral edge 21A is one of essentially zero fluid dead volume. Although a preferred arrangement of compatibly dimensioned components is depicted, it should be understood that tubing face 20A and lateral edge 21A do not need to coincide exactly to provide a sufficient seal with minimal fluid dead volume. Since the fluid dead volume associated with the face seal of the present invention is significantly less than state-of-the-art devices, the possibility of cross contamination among various samples during analysis substantially is eliminated. Also, the growth of bacteria or other related contaminants is inhibited. Thus, microfluidic devices which utilize the fluid connectors of the present invention may be used repeatedly and are not prone to errors resulting from contamination.

Again referring to FIG. 1, in operation, microfluidic device 17 is inserted and supported within recess 16. Proper alignment of tubing 20 and microfluidic device 17 may be achieved using an alignment mechanism. For example, alignment bores 34 and 36 are provided for retaining pins 34A and 36A which engage the corresponding holes in device 17 thereby allowing tubing 20 to be aligned with port 27. Tubing 20, which is to be connected to microfluidic device 17, is positioned within cup seal 21 and is inserted through the axial bore of compression screw 19. Turning compression screw 19 generates a force sufficient to compress an elastic number, i.e., spring 23. The mechanical design of screw 19 and spring 23 provides an applied force to the surface of base 22B of ferrule 22 which is sufficient to create a face seal, as described in detail above, which is capable of withstanding high-pressure. A fluid connector of the invention has been coupled to microfluidic devices and successfully operated at pressures ranging from about 5 psi to about 3,000 psi.

Figure 3:
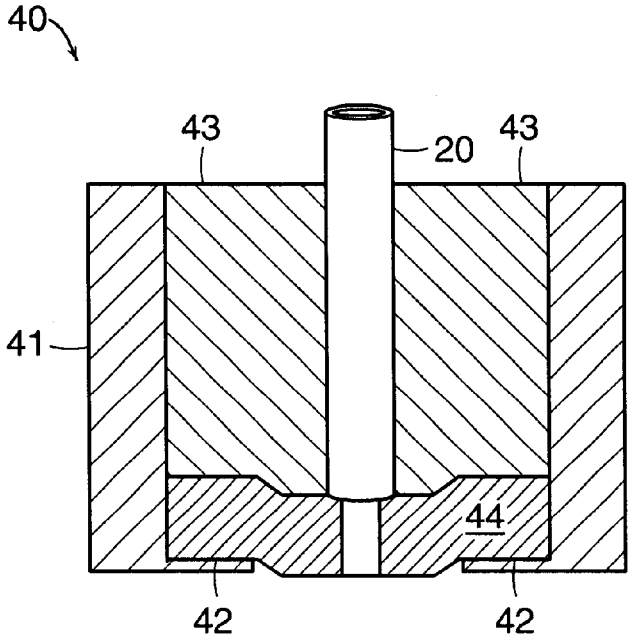
FIG. 3 is a cross-sectional view of an alternative embodiment of a sealing member of the invention.

FIG. 3 shows an example of an alternative sealing member 40 of the present invention. In this example, hollow retainer 41 made of PEEK includes an inwardly extending shoulder 42. Gasket 44 rests within retainer 41 against shoulder 42. Sleeve 43 is dimensioned to fit snuggly over the outside diameter of tubing 20 to help restrain gasket 44 within retainer 41. When an axial force is applied through the combination of compression screw 19 and spring 23 to seal the connection, gasket 44 is of sufficient elasticity to be deformed, as indicated in the drawing, and seal the surface area surrounding port 27.

The gasket may be made from fluoropolymers such ethylene tetrafluoroethylene resins (ETFE), perfluoroalkoxyfluoroethylene resine (PFA), polytetrafluoroethylene resins (PTFE), and fluorinated ethylene propylene resins (FEP). Alternatively, the gasket may be made of an elastomer or other suitably pliant material. Similar to the sealing member depicted in FIG. 2, the seal formed by sealing member 40 provides low fluid dead volume and is capable of withstanding high pressures.

Figure 4:
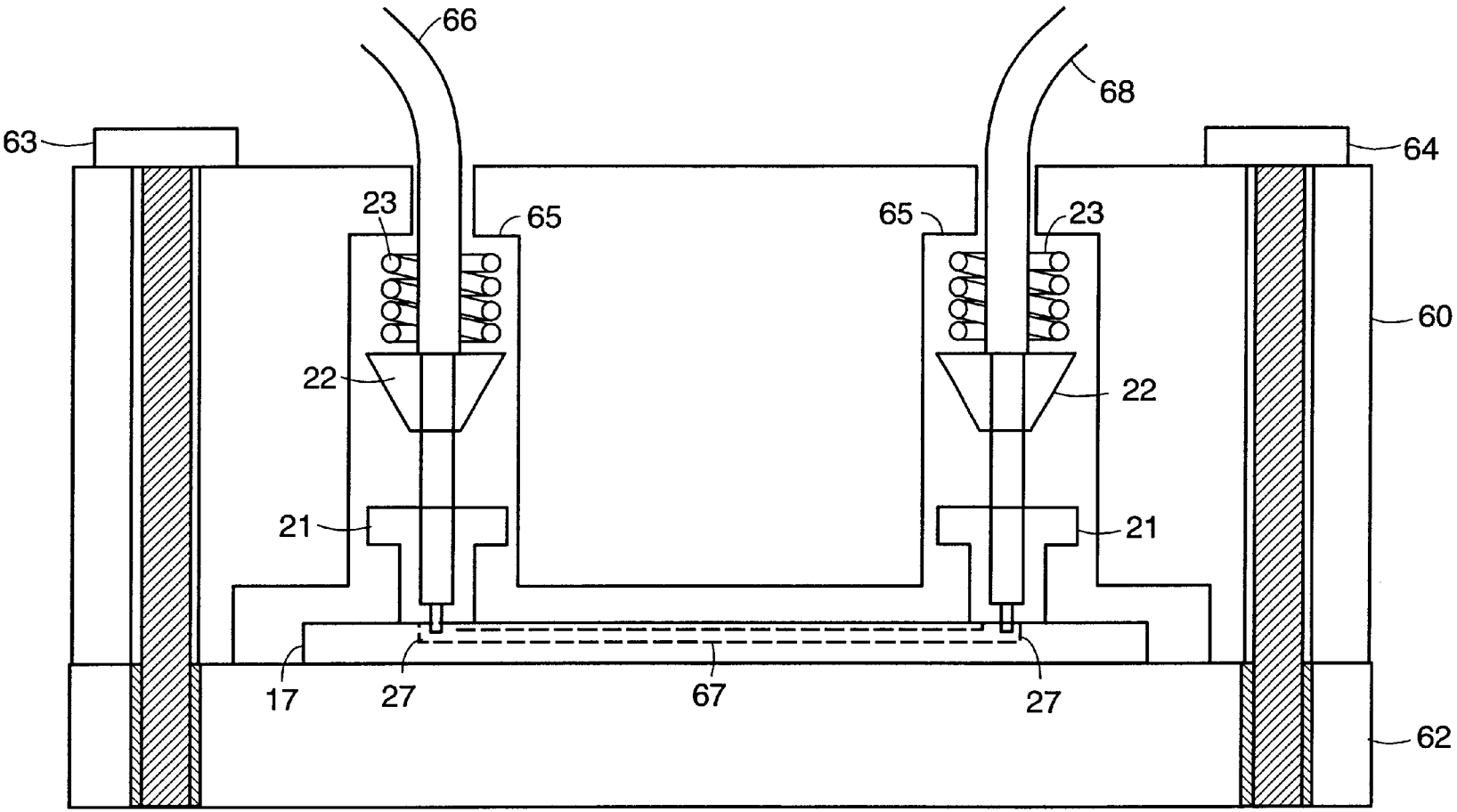
FIG. 4 is a cross-sectional view of another embodiment of the present invention where a top plate is used as the clamping member to couple two fluid connectors to an inlet tube and an outlet tube of a microfluidic device.

FIG. 4 shows another embodiment of the invention for connecting at least two connectors to a microfluidic device. Where appropriate, like elements are represented by the same reference characters as in FIG. 1. In this embodiment, the axial force for creating the seal is generated by mating top plate 60 to bottom plate 62. Microfluidic device 17 rests on bottom plate 62. When top plate 60 is joined to bottom plate 62 by threaded screws 63 and 64, shoulder 65 acts against an elastic member, i.e., compression spring 23, to provide the axial force necessary to create a fluid-tight face seal at the surface area surrounding port 27. With the properly dimensioned fluid connector, an elastic member may be unnecessary to provide sufficient axial force to create a seal in accordance with the invention. That is, shoulder 65, may directly contact ferrule 22, i.e., the first load support surface, to generate the necessary axial force. However, an elastic member positioned between the clamping member and the first load support surface assists in continuously maintaining a fluid-tight seal, especially when the fluid connector experiences a range of temperatures.

Again referring to FIG. 4, fluid-carrying conduit 66 is a fluid inlet to microfluidic channel 67, and fluid-carrying conduit 68 is a fluid outlet. Microfluidic channel 67 may be an electrophoretic separation channel or a liquid chromatography column. In addition, other appropriate hardware may be present, e.g., electrodes, pumps and the like, to practice the intended application, e.g., electrophoretic migration and/or separation, or chromatographic separation. Although two fluid connections are shown, it should be understood that any number of fluid connectors may be used.

Other modifications are possible without departing from the scope of the present invention. For example, the first load support surface upon which the axial force acts may be a laterally extending protrusion formed on the tubing instead of a separate member such as ferrule 22. In addition, with slight modifications to the construction and clamping of plates 12 and 13 as known to those of skill in the art, other suitable elastic members could be used such as a cantilever or leaf spring.

Therefore, additional aspects and embodiments of the invention are apparent upon consideration of the foregoing disclosure. Accordingly, the scope of the invention is limited only by the scope of the appended claims.

What is claimed is:

1. A fluid connector for coupling a fluid conduit to a port of a microfluidic device comprising:

a housing having a bore extending therethrough for receiving the fluid conduit and positioning a first end of the fluid conduit to permit fluid communication between the fluid conduit and the microfluidic device;

a clamping member remote from the first end of the fluid conduit for applying an axial force to the fluid conduit;

a first load support surface operatively coupled to the fluid conduit between the clamping member and the first end of the fluid conduit for receiving the axial force from the clamping member and translating the axial force towards the first end of the fluid conduit; and a sealing member interposed between the first end of the fluid conduit and the surface area surrounding the port of the microfluidic device, the sealing member having a first bore therethrough and comprising a pliant portion, wherein the axial force urges the first end of the fluid conduit into contact with the pliant portion of the sealing member which urges the pliant portion of the sealing member into contact with the surface area surrounding the port of the microfluidic device to effect a fluid-tight seal having minimal fluid dead volume between the first end of the fluid conduit and the port of the microfluidic device.

2. The fluid connector of claim 1 wherein the sealing member further comprises a second bore in fluid communication with the first bore, the second bore for receiving the fluid conduit and having a larger diameter than the first bore thereby defining a second load support surface, wherein the plaint portion of the sealing member comprises the second load support surface.

3. The fluid connector of claim 2, wherein the sealing member is made of ultrahigh molecular weight polyethylene.

4. The fluid connector of claim 2, wherein the sealing member is made of an elastomer.

5. The fluid connector of claim 2, wherein the sealing member is made of a fluoropolymer.

6. The fluid connector of claim 5 wherein the fluoropolymer is selected from the group consisting of ethylene tetrafluoroethylene resins, perfluoroalkoxyfluoroethylene resins, polytetrafluoroethylene resins, and fluorinated ethylene propylene resins.

7. The fluid connector of claim 1 wherein the clamping member comprises a compression screw encompassing the fluid conduit, and the bore of the housing is threaded to accept the compression screw.

8. The fluid connector of claim 1 wherein the first load support surface is a surface of a ferrule which is engaged with the fluid conduit.

9. The fluid connector of claim 1 wherein the first load support surface is a protrusion formed on an outer surface of the fluid conduit.

10. The fluid connector of claim 1 further comprising an elastic member positioned between the clamping member and the first load support surface.

11. The fluid connector of claim 10 wherein the elastic member is a spring.

12. The fluid connector of claim 11 wherein the spring is a compression spring.

13. The fluid connector of claim 1 wherein the housing comprises a top plate and a bottom plate, the top plate including the bore for receiving the fluid conduit, and for securing the fluid conduit remote from the first end of the fluid conduit, wherein the axial force urges the first end of the fluid conduit into contact with the pliant portion of the sealing member when the top and bottom plates are mated.

14. The fluid connector of claim 13 further comprising an elastic member positioned between the first load support surface and the top plate.

15. The fluid connector of claim 1 wherein the housing comprises a top plate and a bottom plate, the top plate of the housing including the bore for receiving the fluid conduit, and the bottom plate of the housing for supporting the microfluidic device.

16. The fluid connector of claim 15 further comprising an alignment mechanism, wherein the alignment mechanism permits the first bore of the sealing member to align and communicate fluidly with the port of the microfluidic device.

17. The fluid connector of claim 16 wherein the alignment mechanism comprises:

a bore in the top plate for receiving a registration pin on the microfluidic device.

18. A microfluidic system comprising the fluid connector of claim 1 and a microfluidic device, wherein the microfluidic device is a microfluidic chip comprising fused silica.

19. A microfluidic system comprising the fluid connector of claim 1 and a microfluidic device, wherein the microfluidic device is a microfluidic chip comprising silicon.

20. A microfluidic system comprising the fluid connector of claim 1 and a microfluidic device, wherein the microfluidic device is a microfluidic chip comprising plastic.

* * * * *